US005685767A

United States Patent [19]

Burds

[11] Patent Number: 5,685,767

[45] Date of Patent: Nov. 11, 1997

[54] SANDBLASTING APPARATUS

[75] Inventor: Denis P. Burds, Dubuque, Iowa

[73] Assignee: Dentinite, L.L.C., Davenport, Iowa

[21] Appl. No.: 497,313

[22] Filed: Jun. 30, 1995

[51] Int. Cl.[6] ..... B24C 3/00

[52] U.S. Cl. ..... 451/75; 451/92; 451/91; 451/439

[58] Field of Search ..... 451/90, 91, 92, 451/434, 354, 439, 75, 86

[56] References Cited

U.S. PATENT DOCUMENTS

| | | | |
|---|---|---|---|
| 2,543,348 | 2/1951 | Briese | 114/222 |
| 2,729,918 | 1/1956 | Denburgh | 451/92 |
| 3,396,423 | 8/1968 | Hope | 15/312 |
| 3,396,492 | 8/1968 | Schenck | 451/92 |
| 3,477,178 | 11/1969 | Hulbert, Jr. | 51/8 |
| 3,548,541 | 12/1970 | Miller | 51/8 |
| 3,566,543 | 3/1971 | Fogle | 451/92 |
| 3,581,441 | 6/1971 | Hulbert, Jr. | 51/8 |
| 3,863,393 | 2/1975 | Goff | 51/9 |
| 3,900,969 | 8/1975 | Diehn | 451/95 |
| 3,984,944 | 10/1976 | Maasberg et al. | 51/9 |
| 4,121,388 | 10/1978 | Wilson | 51/424 |
| 4,199,905 | 4/1980 | Neidigh et al | 51/429 |
| 4,445,451 | 5/1984 | Van Den Broek | 451/92 |
| 4,470,952 | 9/1984 | Vassalotti | 376/316 |
| 5,063,713 | 11/1991 | Buchheit | 451/434 |
| 5,185,183 | 2/1993 | Gonda et al. | 427/236 |
| 5,240,503 | 8/1993 | Levy et al. | 118/323 |
| 5,297,363 | 3/1994 | Schroder et al. | 451/354 |
| 5,419,734 | 5/1995 | Van Sickle | 451/92 |

*Primary Examiner*—James G. Smith
*Assistant Examiner*—Derris H. Banks

[57] ABSTRACT

A sandblasting system including two principal components, a trolley which is located on the flat upper surface of the object to be sandblasted and a blasting machine with an oscillating blast nozzle that is carried by the trolley. For cleaning vertical surfaces, the blast machine is suspended from hoist cables, whose ends are carried by the trolley. The blast machine includes a hoist drum for gathering or releasing the cable to raise or lower the blast machine along the vertical surface. For cleaning horizontal surfaces, the blast machine is carried by the trolley itself and oriented so as to direct the sand blast in a downward direction. The blast machine carries a mechanism for oscillating the blasting nozzle and the hoist drum within a housing to protect the moving parts from the harsh operating environment. The invention is particularly suited for the sandblasting of petroleum product storage tanks.

21 Claims, 9 Drawing Sheets

SANDBLASTING APPARATUS

BACKGROUND OF THE INVENTION

The present invention is directed to a sandblasting apparatus and, more particularly, to an apparatus particularly suited to sandblasting vertical walls as well as horizontal surfaces, such as the sidewalls and top surface wall of cylindrical oil tanks. The invention also can be used to sandblast buildings, monuments, rock surfaces or any similar objects so long as the object has an upper surface of sufficient size for the invention's trolley to sit upon in a manner which will become clear upon further description.

The maintenance of large structures such as oil storage tanks involves the regular cleaning of the structure surface by sandblasting. Typically, an oil storage tank is a large, relatively flat cylinder, having a diameter on the order of one hundred feet or so, and a height on the order of forty feet or so. The cleaning of such a large surface is a major undertaking. It has long been desired to provide an apparatus which can sandblast a structure such as an oil storage tank with a minimum of operator assistance.

The development of such an apparatus has been greatly hampered by the difficult environment imposed by the sandblasting operation. That is, the sandblasting operation subjects moving parts to excessive amounts of wear and causes significant clogging problems for gears, etc. In addition, such structures are not of uniform size, nor is there a common structural feature, e.g. a center post to provide a common reference point for operation of an automated system. The fact that the cleaning operation may need to be performed on both vertical and horizontal surfaces causes further difficulties. As a result, cleaning operations for structures such as oil storage tanks have remained highly labor intensive with the work involved being unpleasant and dangerous for the workers.

SUMMARY OF THE INVENTION

It is an object of the present invention to provide an apparatus which is capable of sandblasting both vertical and horizontal surfaces of structures such as oil storage tanks with minimal worker involvement.

It is a further object of this invention to provide such an apparatus which is readily adaptable to structures of different sizes and shapes.

It is a still further object of this invention to provide an apparatus which is capable of reliable performance with low maintenance, despite the harshness of the environment in a sandblasting operation.

The above objects and others are provided in the present invention, which is directed to a sandblasting apparatus including two principal components, a trolley which is located on the flat upper surface of the oil storage tank or the like and a blast machine with oscillating blast nozzle which is carried by the trolley. For cleaning vertical surfaces, the blast machine is suspended from hoist cables whose ends are carried by the trolley. The blast machine includes a hoist drum for gathering or releasing the cable to raise or lower the blast machine along the vertical surface. For cleaning horizontal surfaces, the blast machine is carried by the trolley and oriented so as to direct the sand blast in a downward direction. The blast machine carries a mechanism for oscillating the blasting nozzle as well as the hoist drum within a sealed housing. This protects the moving parts of the blast machine from the harsh operating environment.

DETAILED DESCRIPTION OF THE PREFERRED EMBODIMENTS

Figure 1:
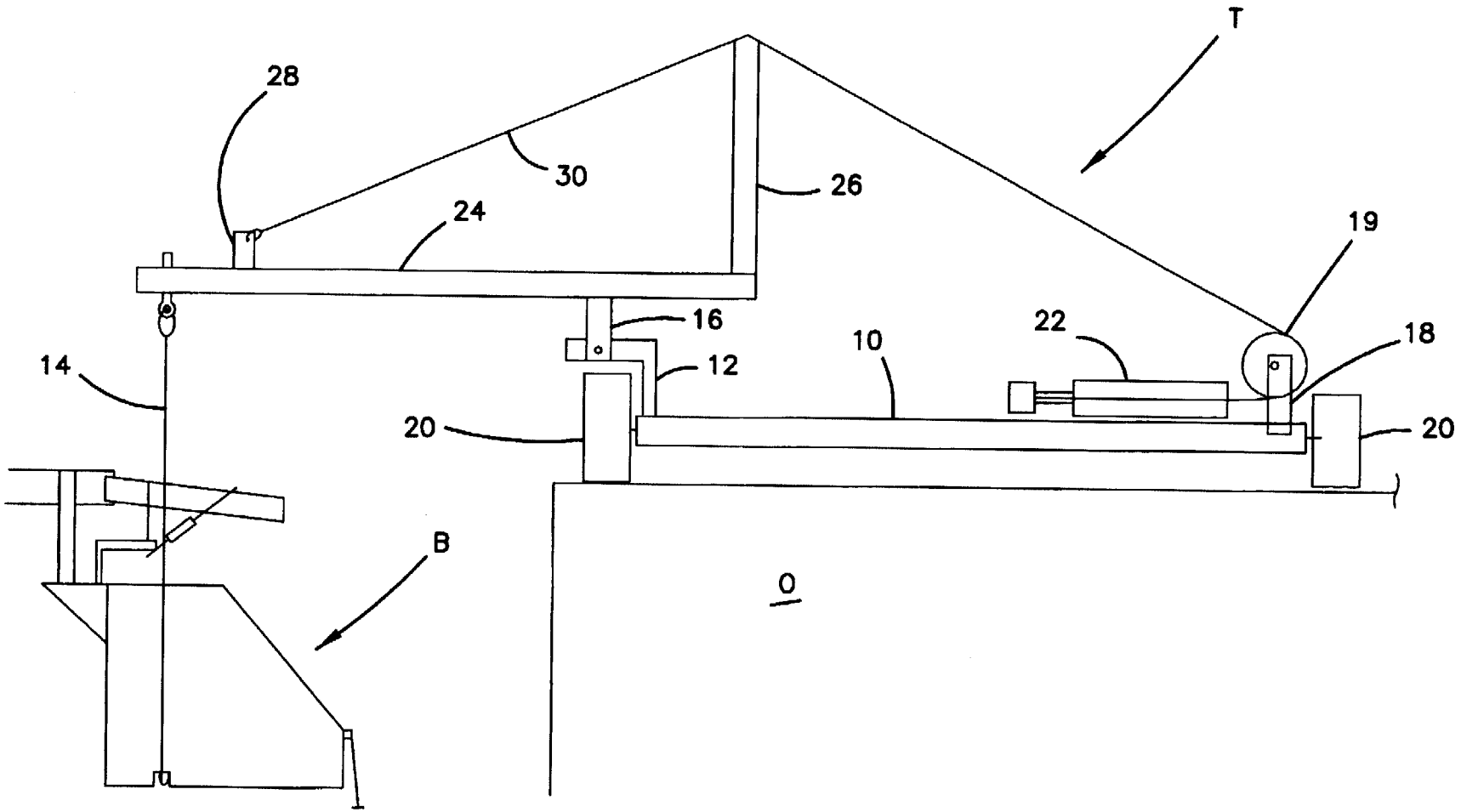
FIG. 1 is an end elevational view of the sandblasting apparatus of the present invention showing the trolley, cable system and blast machine in use sandblasting a vertical sidewall surface.

FIG. 1 shows the sandblasting apparatus according to the present invention being used to sandblast the sidewall surface of object O. As discussed above, object O may be any type of surface that requires sandblasting including, but not limited to, those found on buildings, retaining walls, ships, tanks or the like. The present invention is particularly useful for large structures having a large, substantially flat upper surface, such as oil storage tanks.

Figure 6:
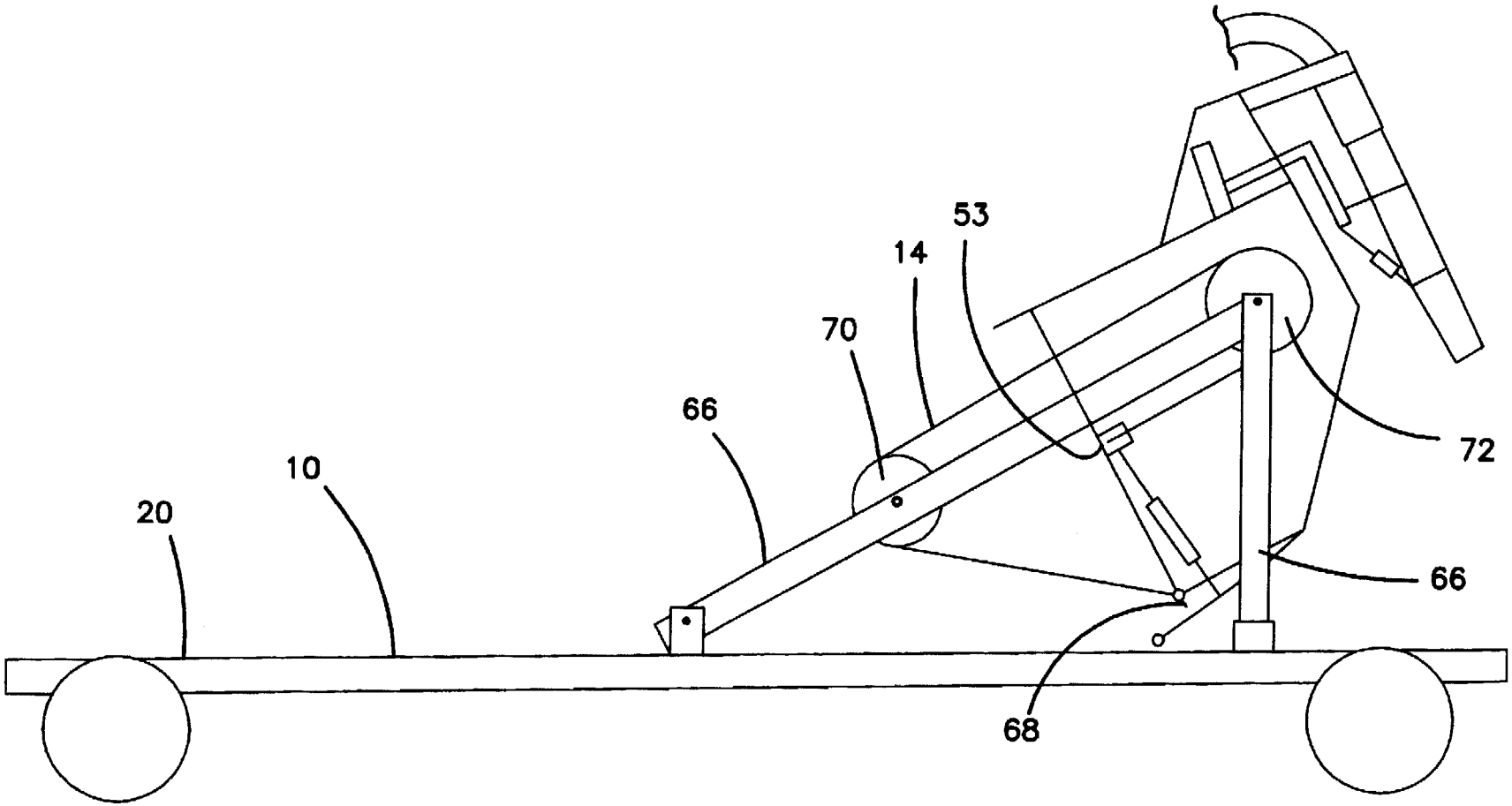
FIG. 6 is a side elevation view of the sandblasting apparatus showing the blast machine being carried by the trolley for blasting a horizontal surface.

The invention includes trolley T having a cable system from which blast machine B and its support frame hang during sandblasting operations. The blast machine B also can be carried by the trolley T in a position as shown in FIG. 6 in which it can be used to sandblast the horizontal surface on which the trolley site in a manner which will be discussed in detail below.

Referring to FIG. 1, the trolley includes a frame 10 with wheels 20. The trolley rides on the horizontal upper surface of the O. For cleaning the vertical side surface of O, the blast machine B is suspended over the side of O. For this purpose, the trolley frame 10 carries a horizontal brace 24, which is pivotable secured to frame 10 by means of support 12 and pivot arm 16. The brace 24 can be used to lift the blasting machine, or to move it closer to the sidewall of O, in a manner discussed in more detail below. The end of brace 24 is provided with a fastener such as a hook eye or similar item for engaging the cables 14 by which the blast machine B is carried. Of course, in the end view of FIG. 1, only one of the cables 14 is shown, although it will be recognized that two cables 14 will be used to suspend the blast machine. The blast machine includes a hoist drum for gathering or releasing the cables 14, as discussed in more detail below. This raises and lowers the blast machine along the sidewall, and in combination with the oscillation of the blasting nozzle, permits the cleaning of a vertical swath on the sidewall of O. In the preferred embodiment described herein, the vertical swath is about six feet wide, although this could readily be changed by one skilled in the art by adjusting the oscillating mechanism.

Figure 2:
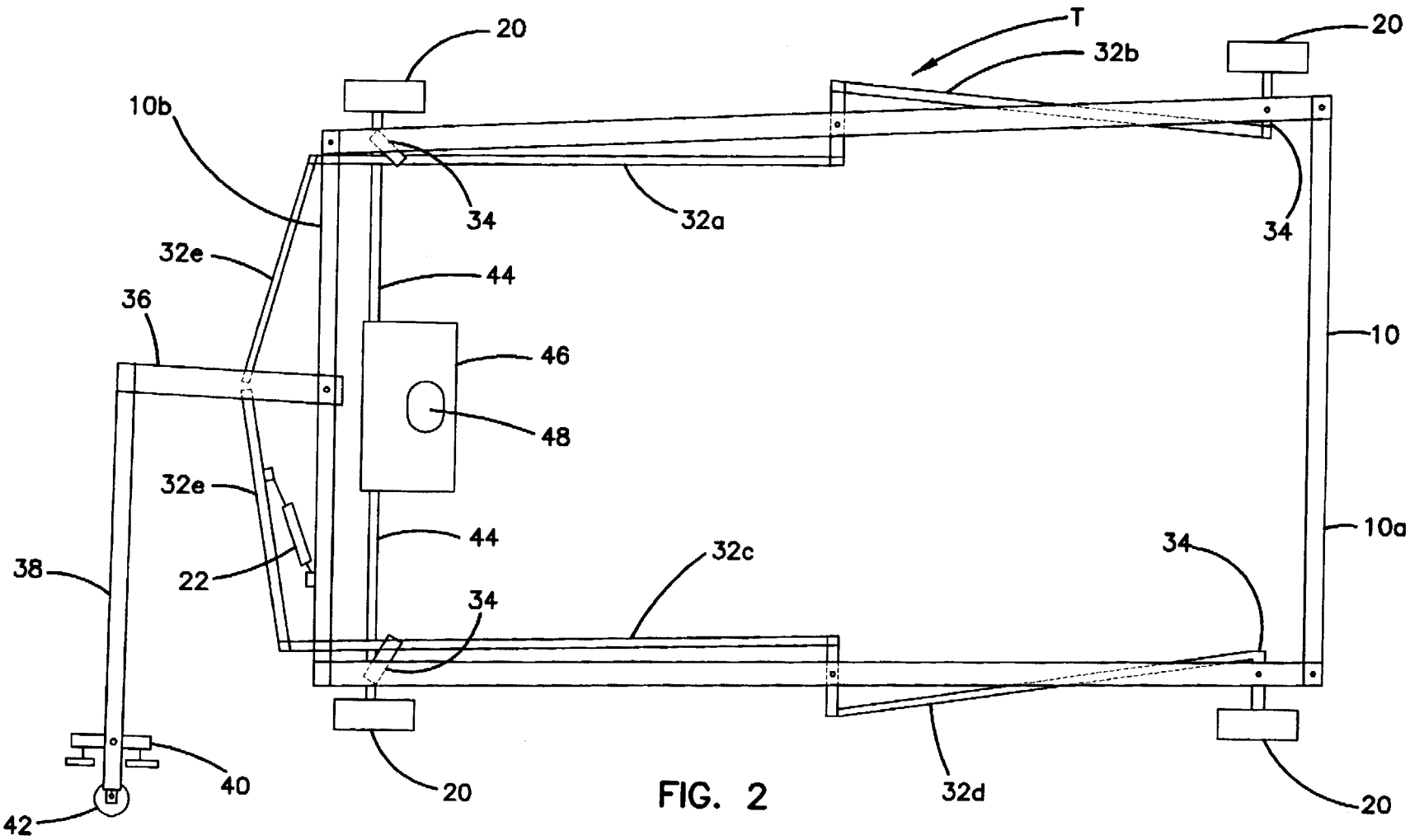
FIG. 2 is a top plan view of the trolley shown in FIG. 1, showing the steering system.

The impulsion and steering systems for trolley T are shown in FIG. 2. For ease of understanding, features of the trolley unrelated to these functions have been omitted from this Figure, these further features being shown and described elsewhere. In FIG. 2, 10*a* represents the frame member for the front of the trolley and 10*b* the frame member for the rear of the trolley. The four wheels 20 are rotatably mounted on pieces which are pivotably secured in the vicinity of the corners of the rectangular frame 10. The trolley steering mechanism includes linkage arms 32*a*, 32*b*, 32*c*, 32*d*, 32*e*, and 32*f* which are pivotably coupled to each other, frame 10, and/or the mounting members for the wheels 20 as seen in FIG. 2. The trolley T can be manually steered via tongue 36, to which linkage arms 32*e* and *f* are pivotably joined. Movement of the tongue 36 causes movement of the linkages 32*e* and *f*, which in turn is translated to the other linkages, resulting in a coordinated pivoting movement for the wheels 20.

Steering of the trolley can be controlled by means of pneumatic piston 22 disposed between frame member 10*b* and linkage arm 32*f*. Expansion or contraction of the pneumatic piston causes relative movement between the frame and the linkage arm 32*f*, which in turn causes movement of the rest of the linkage system, which controls the angle of the wheels in the manner discussed above. It will be appreciated that the piston 22 could be disposed between any of the frame members and linkage arms to obtain a similar result. In addition, a hydraulic piston or other similar device could be used in place of the pneumatic piston if desired. Also, the pneumatic piston can be fitted for automatic operation or remote control operation in accordance with known principles to provide further automation for the steering.

The position of tongue 36 also can be controlled via arm 38. Arm 38 is supported near its end by wheels 40 pivotable mounted to the arm 38. The arm 38 also carries a wheel 42, which in use is disposed next to the sidewall of O, i.e. it is carried at a level below the level of the top surface of O. During operation, the wheel 42 will engage the sidewall of O to prevent inward movement of the tongue 36 beyond a certain point, thus assisting in the guidance of the trolley. It will be understood that the location of the wheel 42 with respect to tongue 36 can be varied, for example by providing for connection of arm 38 to tongue 36 at several optional locations along the length of arm 38.

The trolley T is driven by means of air motor 48 and hydraulic drive 46, which drive the rear wheels 20 through axle 44. The axle 44 is joined to the rear wheels by means of a universal joint, to permit connection to the axle even when the wheels have been turned for steering. The air motor 48 and hydraulic drive 46 are secured to the frame 10 by a suitable cross brace system, which has been omitted for ease of understanding.

Figure 3:
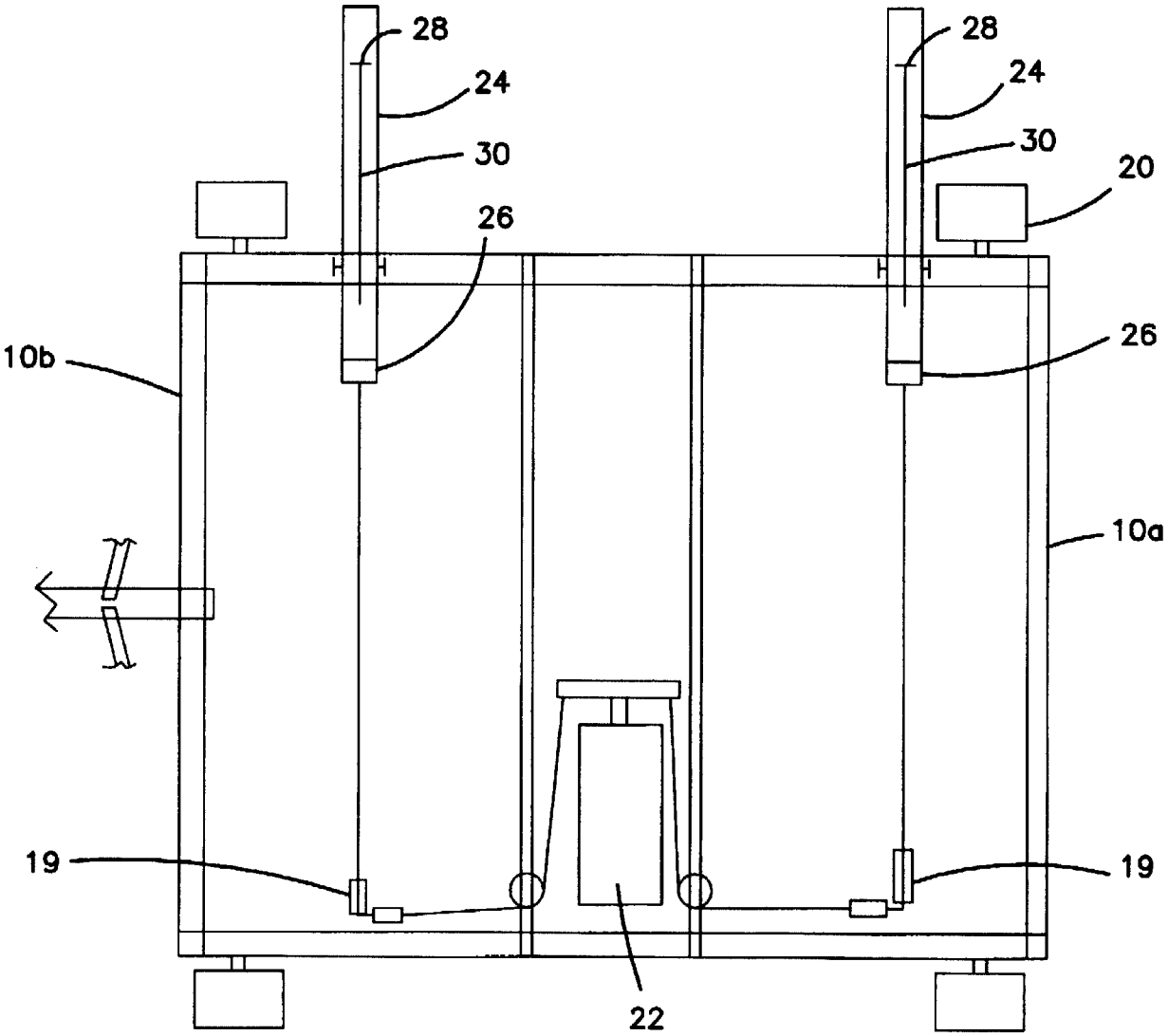
FIG. 3 is a top plan view of the trolley shown in FIG. 1, showing the cable system for lifting the blast machine.

As noted above, the trolley is used for suspending the blast machine B over the side of O, and the features for carrying out this function are shown in FIGS. 1 and 3. With respect to FIG. 3, again features which are not related to this function have been omitted for ease of understanding. As shown in FIG. 1, the trolley T also includes a support 12 carried by frame 10 to which an arm 16 is pivotably connected. Arm 16 is attached to horizontal brace 24. Horizontal brace 24, and the vertical brace 26 orthogonally attached thereto, form a cable hanger. Now referring also to FIG. 3, two such cable hangers are attached to trolley T, one for each side of blast machine B.

Each horizontal brace 24 has a small extension 28 extending upwardly from near the distal end thereof, this extension 28 having a hole therein through which cable 30 is threaded. Of course, the cable could be attached using a fastener or the like. The cable 30 extends from this point over vertical brace 26 to sheave 19. The vertical brace 26 can have an end configured with a guide groove, or can carry a sheave for this purpose. The cable is then connected to the movable ram of air cylinder 22, with a suitable system of sheaves being provided to permit the necessary changes in direction for the cable. In this way, actuation of air cylinder 22 causes the cable hanger to rotate upwardly (in a clockwise direction in FIG. 1) into a more upright position. This permits the blasting machine B to be lifted above the level of the upper surface of O, for example when cleaning of the sidewall is complete. In addition, the rotation of the cable hangers will vary the horizontal positioning of the blast machine B, permitting the machine to be moved closer to or farther away from the sidewall as desired. For example, as the blast machine descends, the tendency of the back pressure generated by the blasting operation to urge the blast machine away from the sidewall increases. This can be counteracted by gradually rotating the cable hangers upwards, which will tend to move the blast machine closer to the sidewall, and this could be done through an automatic timed program which controls the movement of the ram of cylinder 22 if desired.

Figure 4:
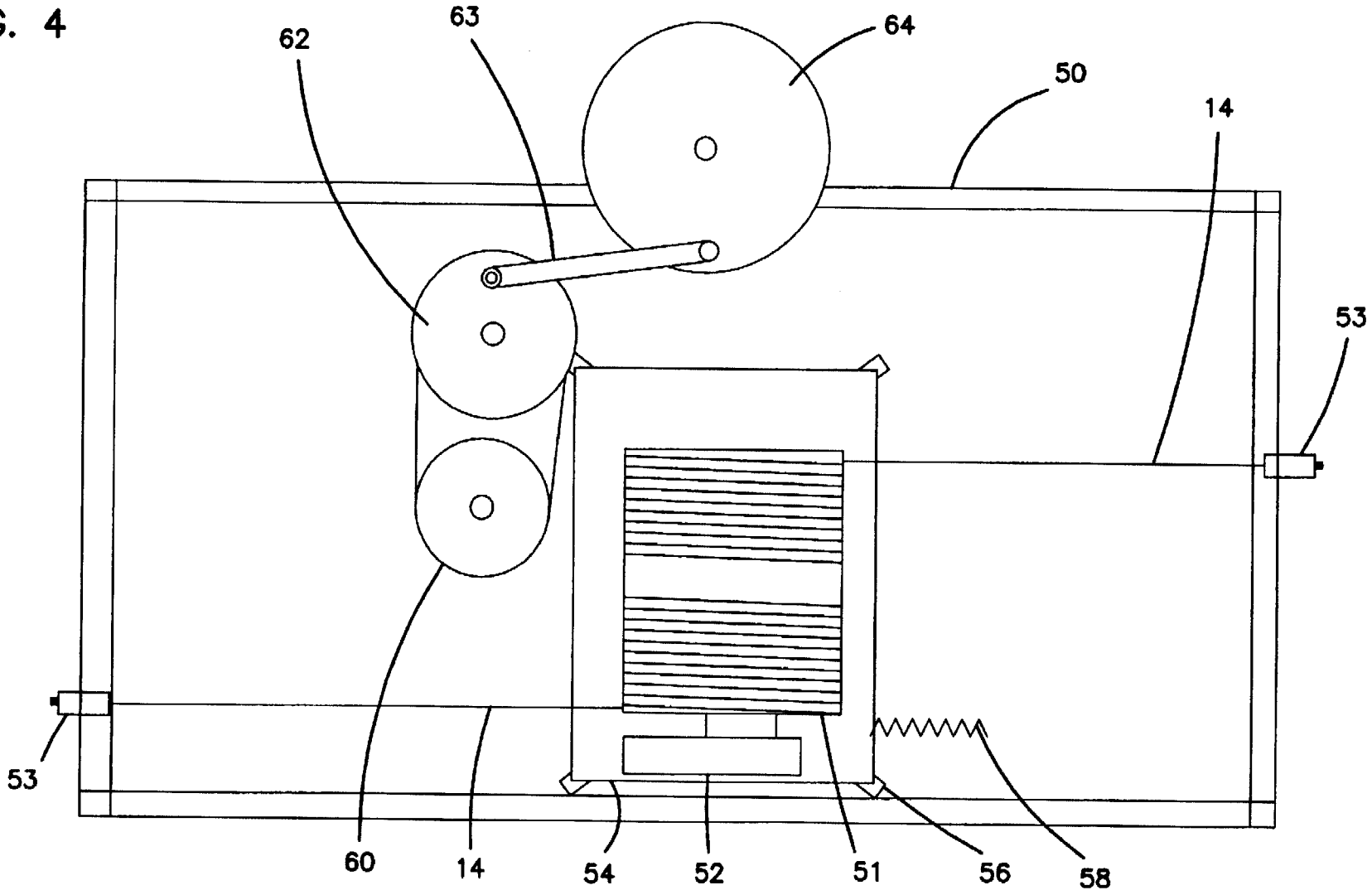
FIG. 4 is a top plan view of the oscillator mechanism for the blast nozzle and hoist system for the blast machine according to the present invention.
Figure 5:
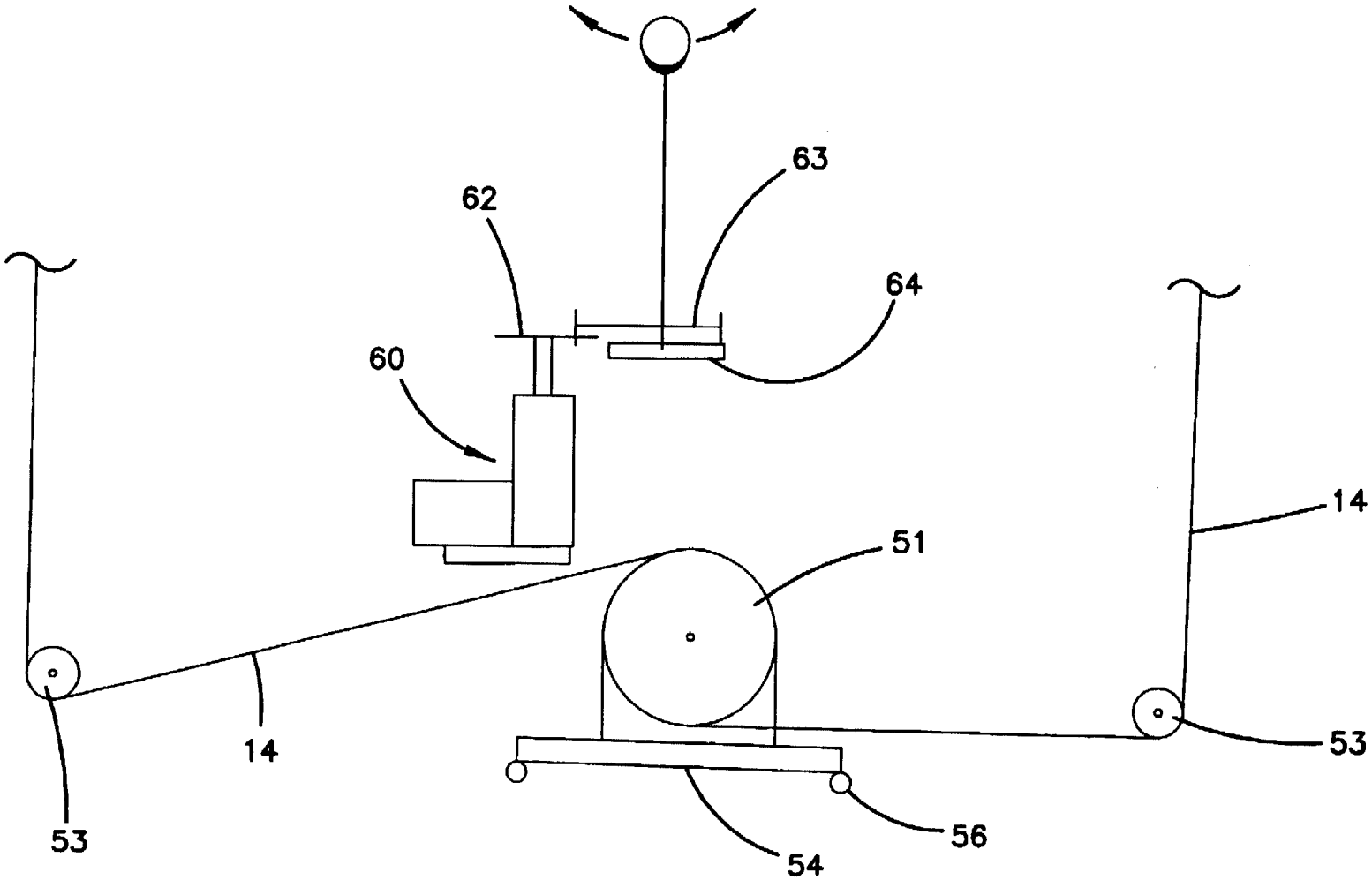
FIG. 5 is a side view of a portion of the hoist system and oscillating mechanism shown in FIG. 4.

Turning now to FIGS. 4 and 5, the operation of the blast machine B will now be described. The blast machine B includes a frame 50. Cables 14 are controlled by rotatable grooved drum 51, which is driven by air motor drive 52. Shaft-mounted guide sheaves 53 can be provided to guide the cables 14 to the grooved drum 51. It can be seen that the cables 14 are not symmetrically disposed with respect to the sides of the blast machine. This is necessary if a single drum 51 is to be used, i.e. it is necessary for the two cables to be wound from opposite ends of the drum 51. Thus, the hooks or eyes at the ends of the horizontal braces 24 which engage the ends of the cables 14 should be disposed at slightly different distances from trolley frame 10 to accommodate the asymmetric positions of the sheaves 53.

The drum 51 and its associated air motor drive 52 are mounted on a table 54. Table 54 is mounted for relative rotation on frame 50. For this purpose, the corners of the table are provided with needle rollers 56. The frame 50 is provided with flat surfaces on which the needle rollers ride, the flat surfaces being provided with stops which limit the rotational movement of the table in accordance with the function described below. The center of table 54 is provided with a post which engages an aperture in a cross member of the frame 50, thus permitting the rotational movement of the table 54.

The table 54 is permitted only a small amount of rotation. A tension spring 58 extends between the table and a member of frame 50, urging the table toward a position in which the table is substantially square with the frame. When the cables 14 have been fully plated out, the cables will be rewound from the ends of the drum. At this point, the cables exert the strongest force for rotation of the table, i.e. when the cables are being wound at the ends of the drum, the rotational force is acting over the largest distance. This rotational force is opposed by the force of tension spring 58, but the force of the tension spring is set so that at this point the rotational force is stronger. Thus, the table will be subjected to a small degree of rotation (due to the presence of the stops discussed above) in a clockwise direction in FIG. 4. This rotation encourages the alignment of the cables 14 with the endmost grooves on the drum 51. As the cables are wound on the inwardly spiralling grooves of drum 51, the rotational force exerted by the winding action decreases, i.e. the lever arm through which force urging the clockwise rotation of the table becomes shorter as the cables move inward from the ends of the drum. As a result, the force of the tension spring is able to overcome the rotational force exerted on the table, and the table moves in a counterclockwise direction as more cable is wound. This encourages the alignment of the cables being wound with more inner portions of the spiral grooves. The mounting of the drum on the table with limited rotational movement thus assists the smooth winding and unwinding of the cables 14. Generally, the drum will be rotated so as to move the blast machine in an upwards or downwards direction at a rate of about five feet per second, although this can be adjusted to fit the circumstances at hand by minor adjustment of parts as will be understood by those skilled in the art.

The blast machine also includes an oscillating drive system for providing oscillating movement to the blast nozzle. This system includes an air motor-driven gear drive 60, which drives rotary connecting drive 62 by means of a suitable belt, chain, etc. The connecting drive 62 is joined to an oscillating drive member 64 by means of link arm 63 in a conventional manner. The shaft carrying the blast nozzle is carried by the oscillating drive member 64. In addition, a stabilizer for the hose can be provided to help ensure that the hose remains connected to the nozzle during oscillation. These are discussed in more detail below. Thus, rotation of the air motor-driven gear drive results in rotation of connecting drive 62, which is converted to oscillating motion for oscillating drive member 64, which thus provides oscillating motion for the nozzle. It has been found that a range of oscillating motion of about 70 degrees (i.e. about 35 degrees to each side of center ) is suitable for most purposes, although different ranges can be accommodated as needed. The various members of this drive system are oriented parallel and perpendicular to each other, and the mounting of shafts on pillow bearings is useful for maintaining these relationships. Generally, a frequency of oscillation of 2.5 times per second is suitable for most sandblasting projects.

The blasting machine is almost fully enclosed by panels on the sides, top and bottom. The only openings to the interior of the machine are found in the vicinity of sheaves 53 and these of course are necessary to permit the passage of the cables 14. In addition, a portion of the oscillating mechanism is located outside the enclosure and there are certain structural members secured to the frame of the blast machine which will extend outside of the panels of the enclosure. However, these can be effectively sealed by gaskets or caulking. In any event, the majority of relatively-moving parts, e.g. the connections of link arm 63 to connecting drive 62 and oscillating drive 64, and the engagement of connecting drive 62 and gear drive 60 to the connecting belt, are disposed within the enclosure. Thus, these moving connections are not subjected to the wear and jamming usually associated with sandblasting operations. Moreover, the two air motors used for operating drum 51 and gear drive 60 vent to the interior of the blasting machine enclosure. This creates a positive pressure within the enclosure, to resist the entry of sand, dust and other debris through the openings for cables 14.

The enclosure panels can be made of any suitable material, for example polystyrene, and the corners can be sealed. While the enclosure is essentially parallelpipedic in nature, the upper front face of the enclosure is slated, which facilitates the blasting of sidewalls near ground level as discussed below. The lower portion of the front face is provided with two hooks 68, near the sides, for reasons discussed below.

The present invention is also capable of sandblasting horizontal surfaces. This feature is shown in FIG. 6. To carry out this operation, the blast machine B is lifted to the upper surface of O, set down and then cables 14 are disconnected from braces 24. Then it is necessary to remove the front frame member 10*a* from the trolley. The front frame member can be secured to the side frame members by removable pins to facilitate this. The side frame members 66 are then mounted on the sides of the frame of the trolley, with both sides of the trolley having the side frame members. The side frame members 66 carry sheaves 70 and 72. The trolley is then positioned so that the blast machine is between the sides of the frame, near the front of the trolley. The cables 14 are then passed over the sheaves 70, 72 and hooked to the hooks 68 on the front of the blast machine. Drum 51 is then actuated to begin winding the cables 14. As the cables are wound, the blasting machine is lifted and rotated in a forward direction. The cables 14 are wound until the blast machine has been rotated about 85 degrees. This leaves the blast machine in a position where it is carried by the trolley, and oriented so that the blast nozzle is directed just in front of the trolley. The trolley can then be driven across the horizontal surface with the oscillating system serving to oscillate the nozzle to sandblast a swath about six feet wide on the horizontal surface.

Figure 7:
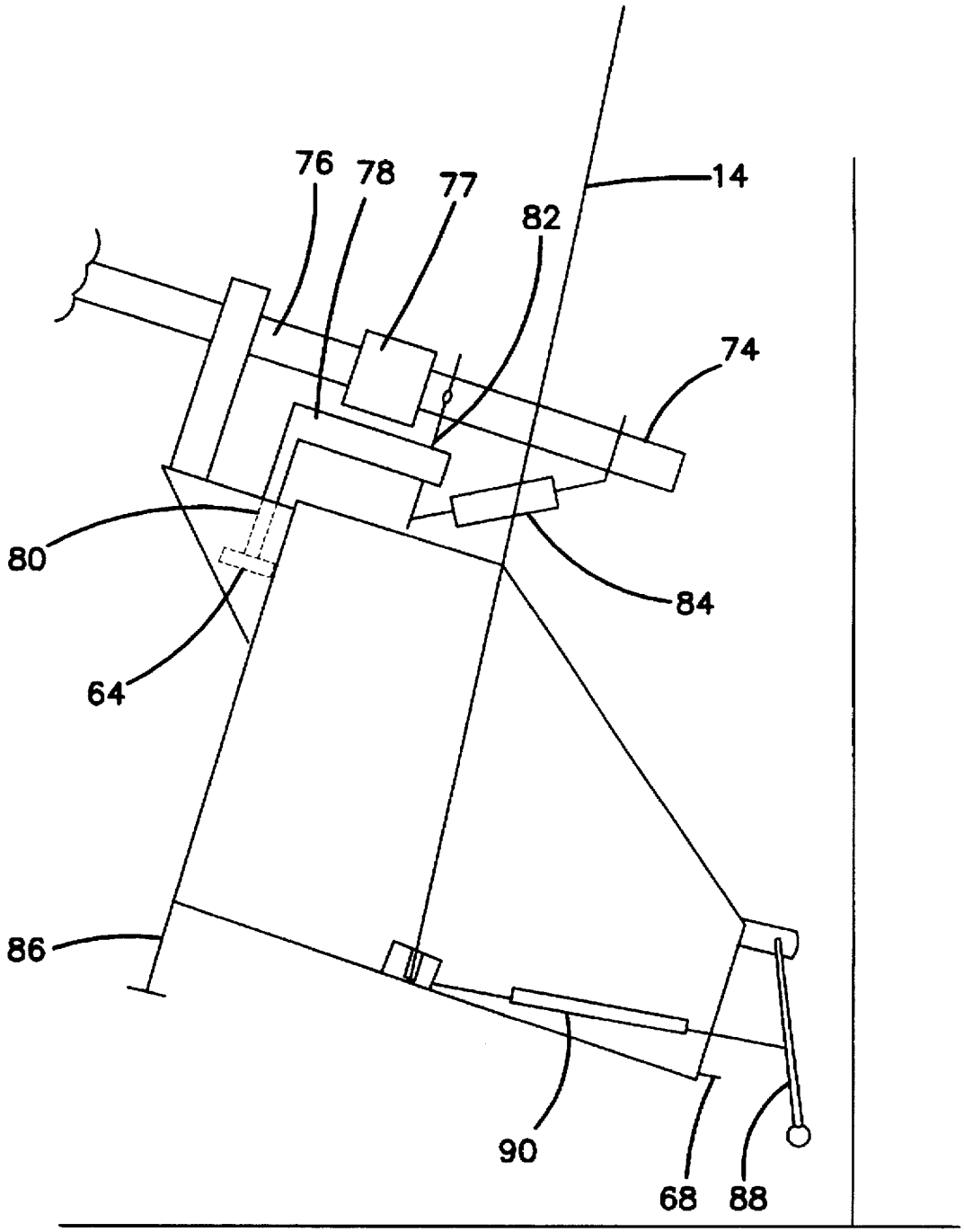
FIG. 7 is a side view showing the blasting operation near the bottom of a sidewall.

Referring now to FIG. 7, blasting nozzle 74 and hose 76 are joined by coupling 77. Hose 76 is connected to a source of air pressure and sand for blasting purposes, which can disposed at ground level or on the top of object O. Of course, a suitable length of hose must be provided to accommodate the full extent of the movement of the blast machine. The nozzle is pivotably carried for movement in a vertical direction by holder 82. Holder 82 is fixed to arm 78, which in turn is carried by a shaft 80 which is fixed to the oscillating drive 64. The vertical position of the nozzle can be controlled by air cylinder 84, which extends between arm 78 or holder 82 and a collar near the end of the nozzle. Again, movement of this cylinder can be actuated by remote control or by an automatic system.

The blast machine is provided with a pair of rear legs 86 and a pair of pivotably mounted front legs 88. Of course, only one of each is illustrated in the view shown in FIG. 7. The position of the front legs is controlled by air cylinder 90, which is secured at one end to the leg and at the other end to the frame of the blast machine. It is convenient to make the connection to the frame through the opening provided for passage of cable 14, although this is not essential.

To clean the portion of a sidewall near ground level, as the blast machine is lowered near to the ground, air cylinder 84 is contracted to pull the nozzle downwards. If additionally downward movement is needed, cylinder 90 can be expanded. This will cause leg 88 to engage the sidewall of O and the pushing action of the cylinder 90 will cause the rear portion of the blast machine to rotate upwards, which in turn causes the nozzle to point in a more downward direction.

Figure 8:
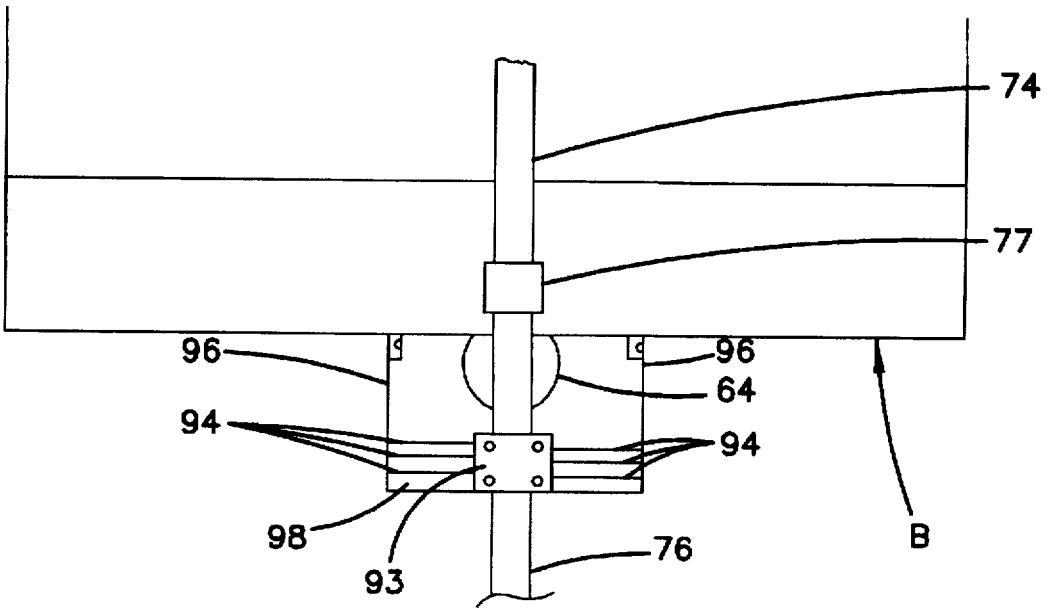
FIG. 8 is a top view of the blast machine showing the mounting of a stabilizer for the sandblasting hose.
Figure 9:
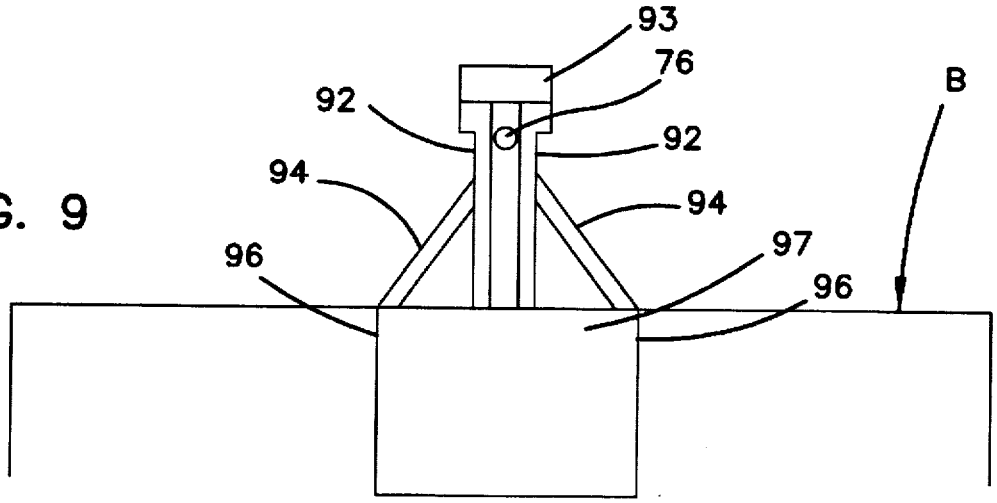
FIG. 9 is an end view showing the mounting of the stabilizer.

The blast machine also includes a stabilizer for the hose 76, which is shown in FIGS. 8 and 9. The stabilizer includes a pair of laterally-spaced vertical pates 92 and a top plate 93. The hose 76 is carried between the plates 92, and the space between the plates accommodates vertical and longitudinal movement of the hose, while providing lateral stability. The hose is retained between the plates 92 by having the space between the plates 92 closed at its upper end by top plate 93. The vertical plates 92 can be formed of 4 inch by 8 inch stainless steel, have a length of 14 inches and be spaced about 3.5 inches apart in a preferred embodiment. Of course, these dimensions van be varied as necessary. The top portions of the plates 92 are bent to form an L-shape. The bent legs at the tops of the plates 92 form a suitable surface for securing top plate 93 tightly to plates 92, for example with bolts.

The stabilizer is carried by a support frame. This support frame includes side plates 96 which are secured, e.g. with bolts, to tabs or ears which are secured to the frame of the blast machine. A cross plate 97 can be provided which joins the distal edges of the plates 96 to close the back of the support frame. A top plate 98 is provided across the tops of the side plates 96. Stabilizer plates 92 can be welded to the top plate, and braces 94 can be welded to the top plate and the stabilizer. The top plate 98 is provided with an aperture to provide an opening for passage of shaft 80. In a preferred embodiment, a double seal is provided for the shaft 80 and top plate 98. A first oil seal is fixed to the top plate, with the shaft 80 oscillating with respect to this first seal. A larger second oil seal is secured to the shaft 80, for example by caulking, and is over the first seal. This arrangement of seals reduces the possibility of sand for debris reaching the moving parts.

Figure 10:
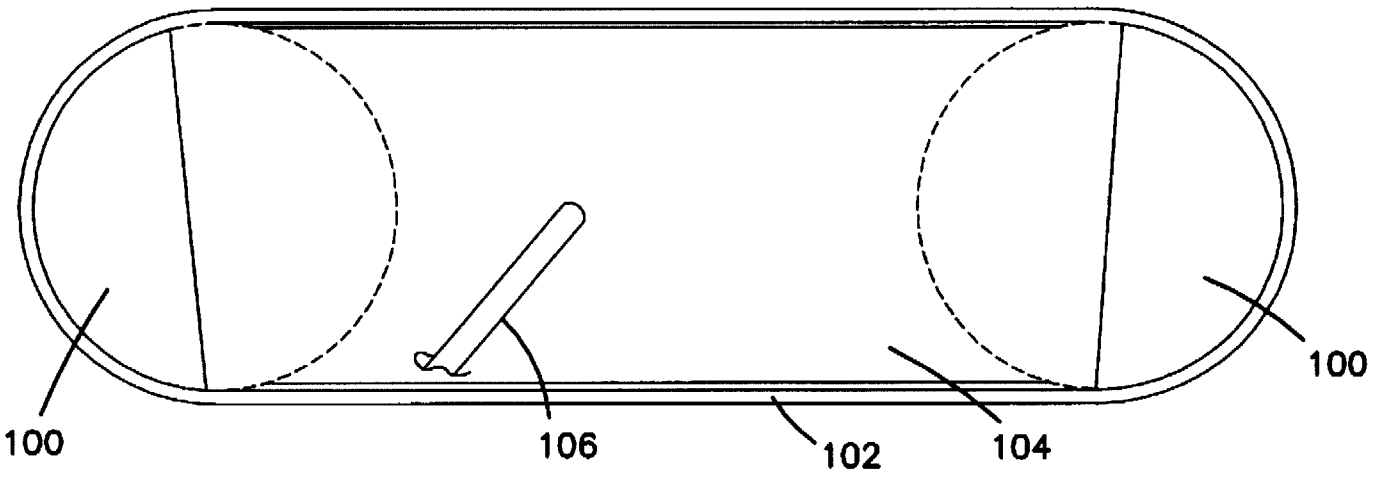
FIG. 10 is a side view of a "caterpillar" which can be used to maintain the blast machine a desired distance from a sidewall.
Figure 11:
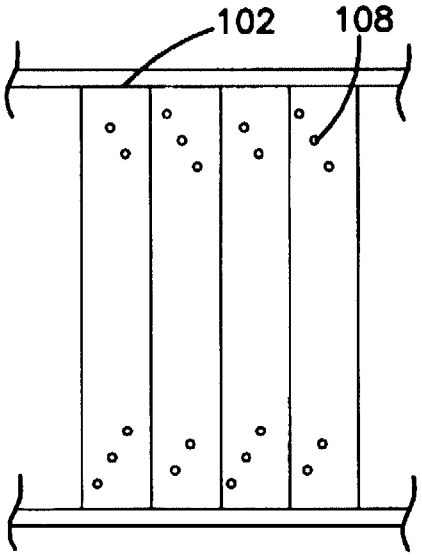
FIG. 11 is a top view showing a portion of a track which is used with device of FIG. 10.

In the embodiment of FIG. 7, the free end of front leg 88 is provided with a wheel to permit smooth and non-damaging contact with a sidewall. This wheel can be replaced with a caterpillar-like device as shown in FIGS. 10 and 11. Such a device includes two cylindrical rollers 100 and a belt 102. In a preferred embodiment, the rollers can be four inches in diameter, have a length of six inches and be spaced on twelve inch centers, although the sizes and relative proportions can be varied if necessary. A belt 102 is carried by the rollers. Frame 104 closes the sides and top (referring to the orientation as shown in FIG. 10) of the device, and provides a support for the belt between the rollers. At the "bottom" of the device, the edges of the belt are supported, while at the top the frame supports the full width of the belt. The belt can be made of a suitable rubber and includes a plurality of narrow, rectangular cup-like members. In one embodiment, these cups can be about five inches long, one inch wide and ⅜ inch deep. Each cup is provided with a plurality of holes, for example ⅜ inch diameter. In a preferred embodiment, five holes are provided in a staggered pattern. These features also can be varied as necessary to meet the needs of the particular situation.

The frame can be provided with a coupling for a vacuum hose 106 connectable to a vacuum source disposed within the blast machine. Since the frame is open on the bottom, suction is created through the openings in the belt for the portion of the belt which is disposed at the bottom of the device, it being understood again that the reference to top and bottom refers only to the orientation as shown in FIG. 10 for ease of reference.

The caterpillar device van be pivotably mounted to front leg 88, with the "bottom" facing the sidewall of O in use. The suction through the apertures in the belt causes the device to be held to the sidewall, which in turn maintains the blast machine the desired distance from the sidewall, with cylinder 90 being capable of controlling the distance. As the blast machine moves downwardly, the belt is moved in a "caterpillar" manner since it is carried by the rolling cylinders 100.

It will be appreciated that the present system is suitable for a high degree of automation. For example, sensing switches can be provided to determine when the blast machine has reached the upper and/or lower limits of the vertical movement, e.g. a switch on the legs of the enclosure which is activated when the blasting machine reaches the ground. These switches could transmit signals to the drive for drum 51, shutting off the drive for the drum and setting it for reversed movement. The switches could also activate cylinders 84 and 90, to orient the nozzle downward to clean the lowermost portion of the sidewall. Similarly, such signals could be used to actuate the impulsion system for the trolley, i.e. indicating that the blasting machine had reached the limit of its movement and the trolley should advance a sufficient distance, e.g. about six feet, to sandblast a new section of the sidewall. Similarly, the steering system could be programmed for automatic operation.

The above is for illustrative purposes only. Modifications can be made, particularly with regard to size, shape and arrangement of parts, within the scope of the following claims.

I claim:

1. A sandblasting apparatus, comprising:

a wheeled trolley having a frame;

a cable hanger pivotably mounted on the trolley;

a blast machine comprising a housing, a blast nozzle and an oscillating system for the blast nozzle, the blast machine being suspendable via cables from the cable hanger; and a drive system for the trolley, the cable hanger being pivotable between a first position in which the blast machine is suspended at a level above the surface on which the trolley rests and a second position in which the blast machine is suspended at a level below the surface on which the trolley rests.

2. A sandblasting apparatus as in claim 1, wherein there are two cable hangers, each having a horizontal leg and a vertical leg extending perpendicular thereto and wherein there is one lifting cable associated with each cable hanger, and further comprising means for lifting said cable hangers which comprise a plurality of sheaves attached to said trolley and spaced from said cable hangers around which said cables extend and a movable ram and air cylinder mounted on said trolley so that when said air cylinder actuates said ram, the lifting cables draw said horizontal legs of said cable hangers into a more upright position.

3. A sandblasting apparatus as in claim 1, wherein the blast machine further comprises a drum for winding and unwinding the cables on which the blast machine is suspended.

4. A sandblasting apparatus as in claim 3, wherein said means for causing said blast nozzle to oscillate includes a first air motor.

5. A sandblasting apparatus as claimed in claim 4, wherein said drum is driven by a second air motor, the first and second air motors venting within the housing of the blast machine.

6. A sandblasting apparatus as in claim 3, wherein the drum is secured on a rotatably mounted table in the housing.

7. A sandblasting apparatus as in claim 6, further comprising stops for limiting rotation of the table.

8. A sandblasting apparatus as in claim 7, further comprising a spring acting on the table for opposing rotational force applied to the table by winding action of the cables on the drum.

9. A sandblasting apparatus as in claim 8, wherein a single drum is provided for winding the cables on which the blast machine is suspended.

10. A sandblasting apparatus as in claim 1, wherein the trolley frame is adapted to carry the blast machine in a position for blasting the surface on which the trolley rests in front of the trolley.

11. A sandblasting apparatus as in claim 10, wherein the blast machine comprises a drum for winding and unwinding the cables on which the blast machine is suspended, the trolley comprising vertically-oriented side frame members that comprise sheaves for carrying the cables from which the blast machine is suspended, whereby free ends of the cables can pass over the sheaves to be secured to the blast machine, so that upon winding of the cables the blast machine is carried by the vertically-oriented side frame members in an orientation to permit blasting of the surface on which the trolley rests in front of the trolley.

12. A sandblasting apparatus as in claim 1, further comprising a shaft carrying the blast nozzle, and an oscillating drive member on which the shaft is mounted and a drive connected to the oscillating drive member, the oscillating drive member being disposed partly within the housing and partly outside the housing, the drive and the connection of the drive to the oscillating drive member being disposed within the housing.

13. A sandblasting apparatus as in claim 1, further comprising a pivotable front leg for contacting a vertical surface being blasted by the blast machine, the orientation of the front leg being variable to adjust the orientation of the blast machine with respect to the vertical surface.

14. A sandblasting apparatus as in claim 13, wherein the front leg is provided with a caterpillar-like device comprising an endless belt and a frame.

15. A sandblasting apparatus as in claim 14, further comprising a vacuum system for evacuating the frame of the caterpillar-like device.

16. A sandblasting apparatus, comprising:

a frame;

a blast machine comprising a blast nozzle, suspended from the frame by a plurality of cables; and a drum assembly, comprising a rotatable drum for winding and unwinding a pair of the suspending cables from opposite ends of the drum, the drum assembly being mounted on the blast machine for swiveling movement with respect to the blast machine.

17. A sandblasting apparatus as in claim 16, wherein the drum assembly is secured on a swivelably mounted table in the blast machine.

18. A sandblasting apparatus, comprising:

a movable frame; and a blast machine comprising a blasting nozzle, carried by the frame;

the frame being adapted to suspend the blast machine at a level below the level of the surface on which the frame rests for blasting a vertical surface below the level of the surface on which the frame rests, and also being adapted to carry the blast machine for blasting a horizontal surface on which the frame rests.

19. A sandblasting apparatus as in claim 18, wherein the blast machine is suspended from the frame with a plurality of cables and the blast machine comprises a drum for winding and unwinding the cables on which the blast machine is suspended, and the frame comprises vertically-oriented side frame members that comprise sheaves for carrying the cables from which the blast machine is suspended, whereby free ends of the cables can pass over the sheaves to be secured to the blast machine, so that upon winding of the cables the blast machine is carried by the vertically-oriented side frame members in an orientation to permit blasting of the surface on which the frame rests in front of the frame.

20. A sandblasting apparatus, comprising:

a frame;

a blast machine capable of being suspended from the frame at a level below the surface on which the frame rests, comprising a blasting nozzle and a front leg; and a caterpillar-like device on the front leg, comprising an endless belt and a frame, for contacting a vertical surface being blasted by the blast machine.

21. A sandblasting apparatus as in claim 20, further comprising a vacuum system for evacuating the frame of the caterpillar-like device.

* * * * *